United States Patent [19]

Rubin et al.

[11] Patent Number: 4,882,094

[45] Date of Patent: Nov. 21, 1989

[54] SEPARATION SYSTEM FOR DEWATERING RADIOACTIVE WASTE MATERIALS

[75] Inventors: Leslie S. Rubin, Newton; Hans A. Hug, Weston, both of Mass.

[73] Assignee: Foster-Miller, Inc., Waltham, Mass.

[21] Appl. No.: 160,920

[22] Filed: Feb. 26, 1988

[51] Int. Cl.[4] ..... G21F 9/12; G21F 9/24; B04B 11/02; B04B 5/10

[52] U.S. Cl. ..... 252/633; 210/295; 210/360.1; 210/378; 250/506.1; 250/507.1; 252/626; 422/72; 494/4; 494/5; 494/36; 494/40; 494/41

[58] Field of Search ..... 252/631, 633; 422/71, 422/72; 494/4, 5, 12, 13, 36, 40.1; 210/682, 203, 295, 360.1, 360.2, 378, 572.1; 55/DIG. 9; 376/313

[56] References Cited

U.S. PATENT DOCUMENTS

| | | | |
|---|---|---|---|
| 1,995,926 | 3/1935 | Kirby | 68/26 |
| 2,106,986 | 2/1938 | Pearce | 68/1 |
| 2,120,139 | 6/1938 | Tholl | 233/2 |
| 3,279,686 | 10/1966 | Hubmann | 494/36 |
| 3,300,051 | 1/1967 | Mitchell | 210/361 |
| 3,311,236 | 3/1967 | Hurst | 210/360.1 |
| 3,647,135 | 3/1972 | Mercier | 233/2 |
| 3,658,179 | 4/1972 | Baumann et al. | 210/452 |
| 3,946,940 | 3/1976 | Tadokoro | 233/2 |
| 4,061,480 | 12/1977 | Frye et al. | 55/356 |
| 4,234,449 | 11/1980 | Wolson | 252/629 |
| 4,357,962 | 11/1982 | Shaw, deceased et al. | 138/125 |
| 4,585,558 | 4/1986 | Rubin | 210/378 |
| 4,586,624 | 5/1986 | Shaw | 220/67 |
| 4,698,156 | 10/1987 | Bumpers | 210/360.1 |
| 4,722,792 | 2/1988 | Miyagi et al. | 210/360.1 |
| 4,724,076 | 2/1988 | Deguchi et al. | 210/360.2 |

FOREIGN PATENT DOCUMENTS

| | | | |
|---|---|---|---|
| 2814199 | 10/1979 | Fed. Rep. of Germany | 494/36 |
| 3629374 | 3/1988 | Fed. Rep. of Germany | 210/360.2 |

OTHER PUBLICATIONS

"Donaldson HIPAC Centrifuge", Donaldson Company, Inc. (Technical Information).

*Primary Examiner*—Howard J. Locker

[57] ABSTRACT

Disposal container structure for the disposal of waste radioactive materials includes inner structure comprising a cover member with an inlet port and an annular seal surface portion, and depending filter structure attached to the cover structure that includes circumferential side wall structure and bottom wall structure that defines an enclosed chamber volume in which waste materials are introduced for storage therein through the inlet port. The container structure further includes outer structure that has circumferential side wall structure corresponding in shape to the filter structure of the inner structure, bottom wall structure that defines a chamber for receiving the filter structure of the inner component, and annular seal surface structure formed on the side wall structure for mating with seal surface structure of the inner structure to seal the storage chamber volume defined by the filter structure. Discharge passages across the seal surface provide flow paths for discharge of liquid from the region between the circumferential inner surface of the outer structure and the circumferential outer surface of the filter portion of the inner component. The container structure also includes drive surfaces for mating engagement with centrifuge structure for releasably engaging drive surfaces of a centrifuge system for subjecting the container structure to centrifugal forces in excess of about fifty Gs for separating water and similar liquids from solids retained within the chamber structure of the inner component.

30 Claims, 4 Drawing Sheets

SEPARATION SYSTEM FOR DEWATERING RADIOACTIVE WASTE MATERIALS

This invention relates to separation systems, and more particularly to systems for the disposal of materials such as radioactive waste materials that are produced, for example, in connection with operation of a nuclear power plant.

The disposal of radioactive waste presents significant economic and environmental challenges. For example, the disposal of spent resin waste from a single nuclear power plant using contemporary disposal technology can cost more than one million dollars per year. In accordance with present federal regulations, spent resin low level radioactive waste must have its free water content reduced to less than one half volume percent before the dewatered waste may be buried for storage in order to minimize the threat of future contamination of soil or ground water at the burial site.

A principal technique for preparing low level spent resin for burial presently utilizes liner dewatering technology in which an external pump draws liquid from the bottom of a drum through perforated pipes. Other preparation technologies include the addition of a solidification agent to the spent resin slurry in sufficient quantity to bind all free water in the resin slurry; and dewatering using either batch or continuous centrifugal separation technology.

In accordance with one aspect of the invention, there is provided disposal container structure for the disposal of waste radioactive materials, the container structure including inner structure comprising a cove member that has an inlet port and an annular seal surface portion, and depending filter structure attached to the cover structure that includes circumferential side wall structure and bottom wall structure that defines an enclosed chamber volume in which waste materials are introduced for storage therein through the inlet port. The container structure further includes outer structure that has circumferential side wall structure corresponding in shape to the filter structure of the inner structure, bottom wall structure that defines a chamber for receiving the filter structure of the inner component, and annular seal surface structure formed on the side wall structure for mating with seal surface structure of the inner structure to seal the storage chamber volume defined by the filter structure. Discharge passages across the seal surface provide flow paths for discharge of liquid from the region between the circumferential inner surface of the outer structure and the circumferential outer surface of the filter portion of the inner component. The container structure also includes drive surfaces for mating engagement with centrifuge structure for releasably engaginq drive surfaces of a centrifuge system for subjecting the container structure to centrifugal forces in excess of about fifty Gs for separating water and similar liquids from solids retained within the chamber structure of the inner component.

In preferred embodiments, the container has a volume of at least about thirty gallons, and the materials of the cover and outer container structures are polymeric materials with excellent resistance to chemical corrosion, and ultraviolet and gamma radiation; have tensile and compressive strengths in excess of 10,000 pounds per square inch; and the container withstands centrifugal forces in excess of fifty Gs for dewatering and compacting waste materials. The filter structure has an effective porosity of less than about one hundred microns. The seal surfaces are of thermoplastic materials and the container further includes means for heating the seal surfaces to place the seal surfaces in the second configuration. The container further includes clamp structure for mechanical securing the cover structure to the outer container structure with the seal surfaces in juxtaposed engagement.

In a particular embodiment, the clamp structure is of ring configuration and includes flow passages that are aligned with the liquid discharge flow paths of the container, and bracket structure for securing the container in centrifuge apparatus. The filter structure includes annular support structure and filter fabric disposed on the inner surface of the annular support structure has a porosity of less than about one hundred microns for retaining solids within the chamber volume. The outer container structure and the cover structure of the inner container structure each includes an inner layer of thermoplastic material (polyethylene) and an outer layer of fiber reinforced polymeric (polyester) material laminated to the inner layer. Means are embedded in the inner layer for heating the seal surfaces to place the seal surfaces in the second configuration.

In accordance with another aspect of the invention, there is provided a separation system for dewatering radioactive waste materials includes disposal container structure for use in disposal of radioactive materials. That container structure comprises inner container structure with filter structure defining a chamber volume of at least about five cubic feet, the filter structure including circumferential foraminous wall structure with filtering characteristics to retain solid material while passing liquid material, and lid structure secured to the filter structure, the lid structure, including means defining an inlet port, and first annular seal structure at the periphery of the lid structure. Outer container structure includes base and side wall portions that conform essentially to and receive the filter structure of the inner container structure, and second annular seal surface adjacent the top of the side wall structure for juxtaposition with the first annular seal surface, the first and second annular seal surfaces having a first configuration providing liquid flow paths for flow of liquids from the chamber volume through the filter structure for flow externally of the container structure under the influence of centrifugal force, and a second configuration in which the seal surfaces are in sealing engagement to provide a sealed high integrity disposal container. The system also includes drive structure for receiving the container structure, the drive structure including drain passage structure for alignment with the liquid flow paths provided by the first and second seal surfaces for receiving liquid passed through the filter structure under the influence of centrifugal force, means for driving the drive structure in rotation to subject to the container to centrifugal forces in excess of fifty Gs, and means for releasably attaching the container structure to the drive structure.

In a particular embodiment, the drive structure includes frame structure, stationary circular drainage chamber structure for receiving liquids discharged from the container structure, and vibration isolation structure connected between the frame structure and the drainage chamber structure for accommodating changing mass distribution and varying center of gravity during system operation. The system also includes feed tube structure adapted to be inserted through the inlet port for introducing waste material to be dewatered into the chamber volume, and material sensing apparatus coupled to the feed tube, the material sensing apparatus including conduit structure that extends into the container through the inlet port and sensor means coupled to the conduit structure external of the drive structure for sensing the quantity of material in the container. In a particular embodiment, the sensing system includes a source of low pressure gas and the sensor indicates the container is full in response to an increase in pressure in the conduit. Other sensing systems such as fiber optics or ultrasonic may be used in appropriate applications.

Other features and advantages will be seen as the following description of a particular embodiment progresses, in conjunction with the drawings, in which.

DESCRIPTION OF PARTICULAR EMBODIMENT

Figure 2:
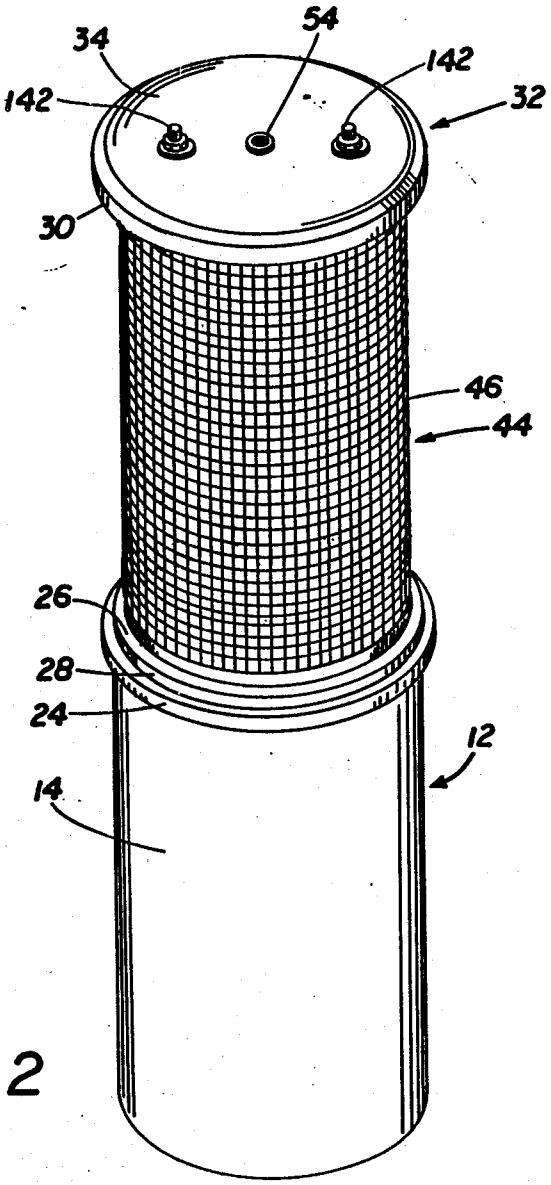
FIG. 2 is a perspective view of components of the storage container shown in FIG. 1.
Figure 1:
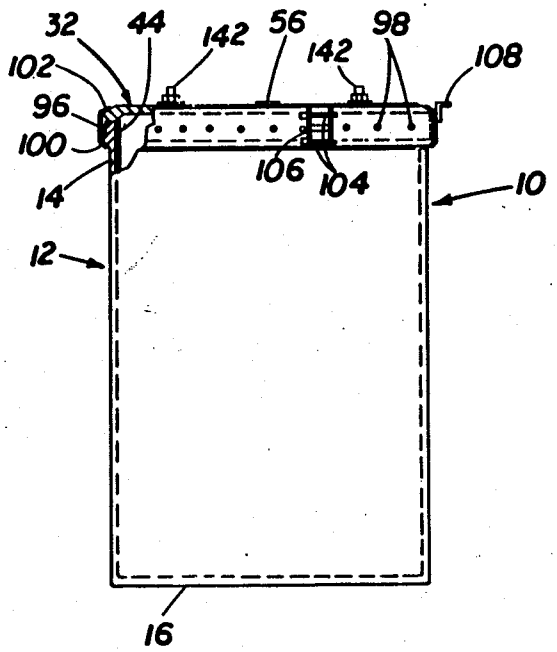
FIG. 1 is a side elevational view (partially in section) of a storage container in accordance with the invention.
Figure 3:
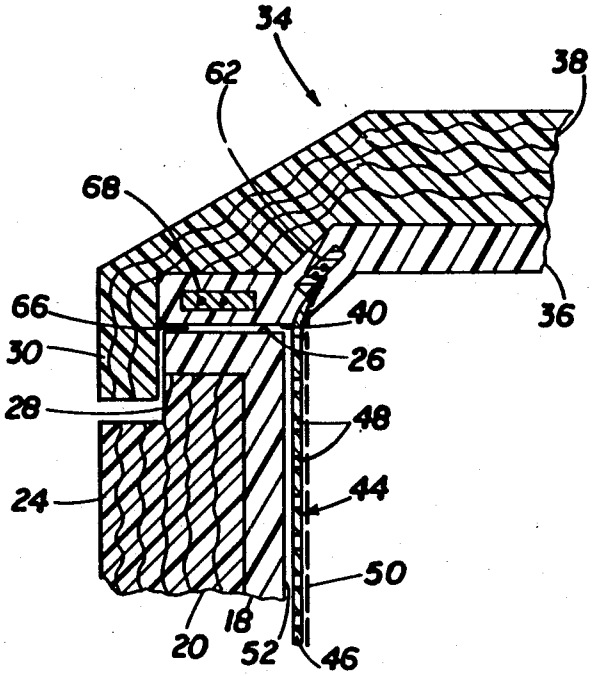
FIG. 3 is an enlarged section view of a portion of the storage container shown in FIG. 1.

The disposal container 10 shown in FIGS. 1–3 is of the high integrity type suitable for burial of low level radioactive wastes and has a capacity of about fifty-five gallons. Container 10 includes outer component 12 that has tapered (1°) circumferential side wall 14 and base wall 16, each composed of inner polyethylene layer 18 (about 0.4 centimeter thick) and fiberglass reinforced polyester outer layer 20 (about one centimeter thick). At the upper edge of side wall 14 is annular flange portion 24 with horizontal seal surface 22 and recess 28 that receives lip 30 of inner component 32.

Inner component 32 includes lid or cover member 34 that also includes 0.4 centimeter thick inner layer 36 of polyethylene and 1.8 centimeter thick outer layer 38 of fiberglass reinforced polyester. An annular planar seal surface 40 is formed at the periphery of cover 34. Sealed to and depending from the inner surface of layer 36 is filter structure 44 that includes outer layer 46 in the form of foraminous polyethylene support member (with ⅛" diameter holes 48 and fifty percent open area) on which is disposed nylon fabric 50 that has a pore size of about eighty microns and extends over the entire inner surface (side and bottom walls) of support screen 46. A discharge channel is provided between filter structure 44 and the inner surface 52 of layer 16 when seal surfaces 26, 40 are in juxtaposition. Port 54 in cover member 34 is adapted to be closed by sealing plug 56.

An enlarged view of the seal surfaces 26, 40 is shown in FIG. 3. As there indicated, structural screen support 46 and filter fabric 50 are secured to and embedded in layer 36 of cover member 34 so that the depending filter container 44 is sealed to cover 34 with a continuous annular seal. Heating element 62 (for example, of the type shown in Shaw U.S. Pat. No. 4,586,624) is embedded in polyethylene layer 36 and when energized, melts thermoplastic layer 36 to provide a heat seal of the filter structure 44 to the cover 34. As shown in FIG. 3, cover lip 30 rests over recess 28 with flow channels 66 provided between seal surfaces 22, 40. A heating element 68, similar to heating element 62, is embedded in thermoplastic layer 36 adjacent seal surface 40.

Figure 5:
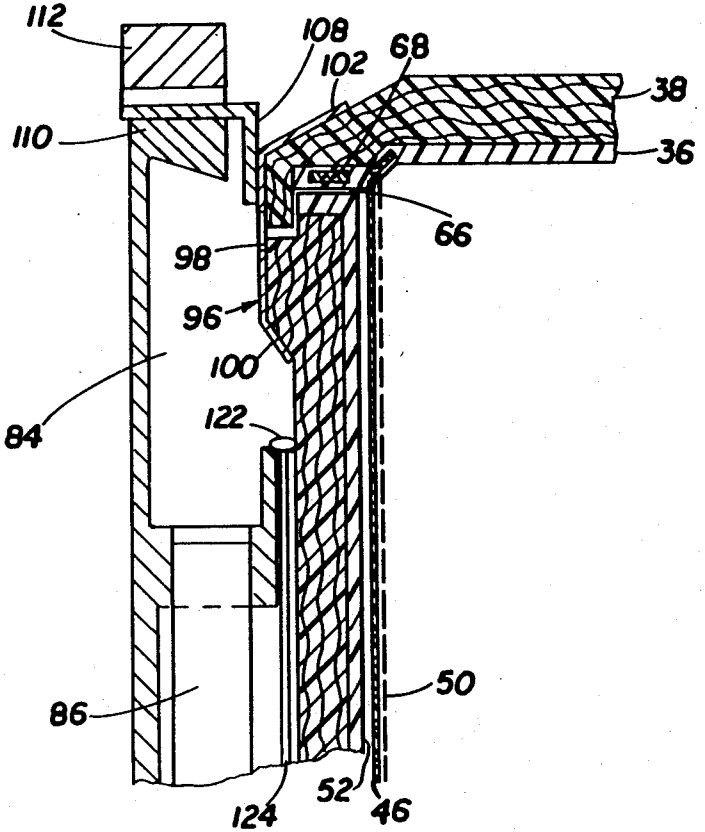
FIG. 5 is an enlarged section view of a portion of the separation system shown in FIG. 4.

Secured to container assembly 10 is clamp ring or band 96 that has a series of peripheral drainage holes 98. Clamp band 96, as indicated in FIGS. 1 and 5 is of U-shaped configuration and has lower leg 100 that engages flange 24 and upper leg 102 that engages the inclined edge of cover 34. Bolts 104 (FIG. 1) engage lugs 106 to clamp band 96 in place over the flange 24 and cover 24, the inclined legs 100, 102 providing clamping action to secure cover 32 on body component 12. Bracket members 108 are secured to clamp band 96.

Figure 4:
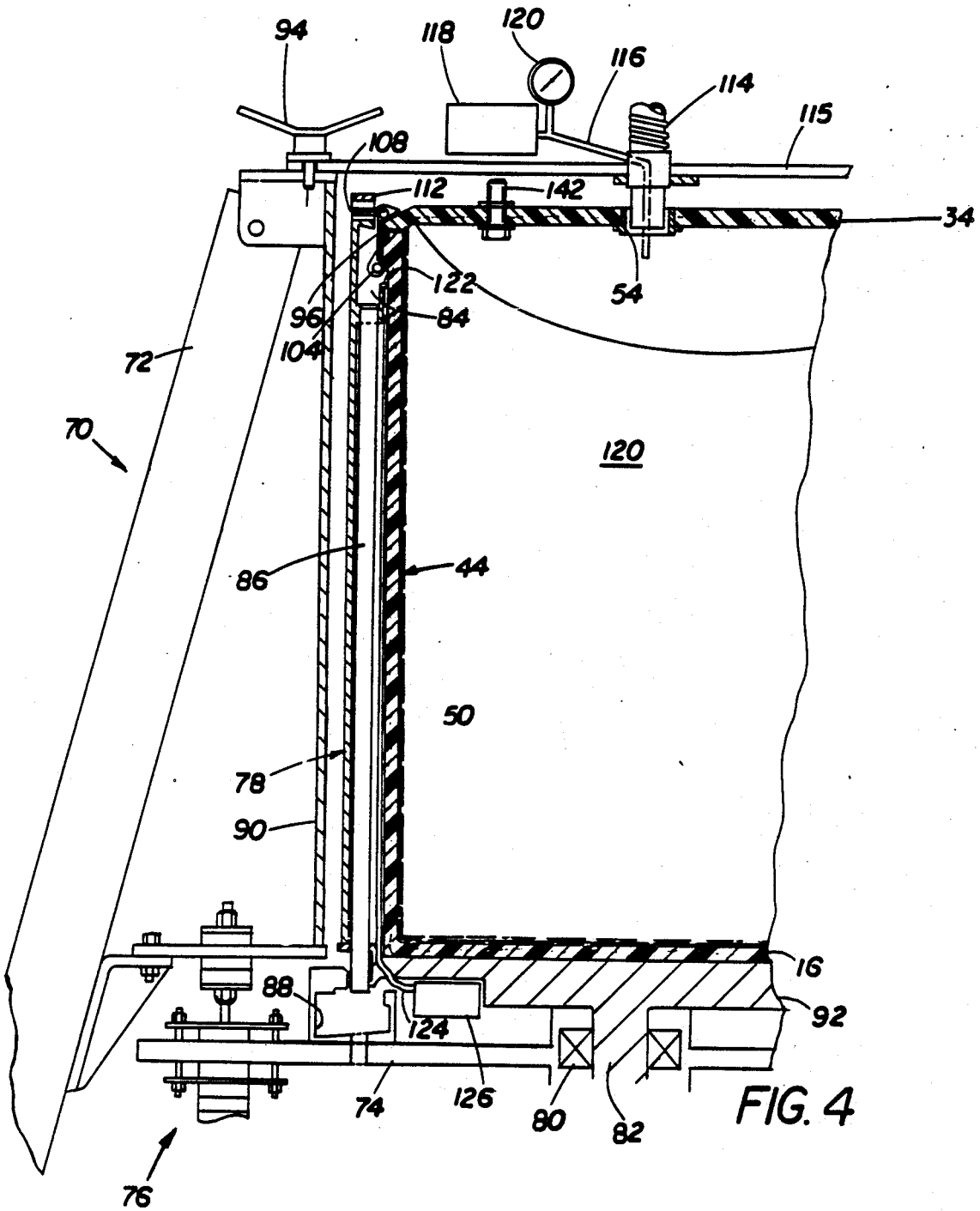
FIG. 4 is a sectional view of centrifuge apparatus employed with the container structure shown in FIG. 1.

Container assembly 10 is arranged to be received in centrifuge assembly 70, further details of which may be seen with reference to FIGS. 4 and 5. Assembly 70 includes I beam supports 72 and frame structure 74 that is supported from frame 72 by vibration isolaters 76. This suspension accommodates changing mass distribution and varying center of gravity that occurs during centrifuge operation. Centrifuge bowl 78 is supported by suitable bearing assembly 80 and driven in rotation via drive shaft 82 by a suitable drive motor. Centrifuge bowl 78 includes gutter structure 84 with depending drain passages 86 that extend into fixed affluent chamber 88 and is housed in fixed cylindrical wall 90. Container 10 is inserted into bowl 78 and seated on base 92, with bracket members 108 received in recesses 110 of the gutter structure 84 and secured with clamp structures 112 to secure the container 10 in the centrifuge assembly 70.

In that position, as indicated in FIG. 4, and with centrifuge cover 115 secured in place by fastener 94, feed pipe 114 extends through inlet port 54 of container 10 for introduction of resin or other material to be dewatered. Feed pipe 114 carries sensor tube 116 (one-quarter inch diameter hydraulic tubing) to which pressure source 118 and pressure gauge 120 are coupled. Low pressure compressed air is passed through tube 116 into the container drum 10. When solids contact the discharge end of tube 116, an abrupt rise in pressure indicated by sensor 120, provides an indication that drum filling is complete.

Further details of gutter structure 84 may be seen with reference to FIG. 5. Clamp band 98 with thirty-two one-half inch diameter holes 98 spaced about its length is aligned with a gap between flange 30 and recess 28 for flow of liquid into gutter structure 84. Drain channels 86 extend downwardly from gutter 84. At the inner periphery of gutter 84 is centrifugally-activated expandable seal 122 that is connected by line 124 to liquid reservoir 126 (FIG. 4) that is located radially inwardly at the base of centrifuge bowl 78.

In system operation, an empty container 10 is inserted into centrifuge bowl 72 and secured with fasteners 112. In the assembled position, through passages 66 are aligned with gutter 84. Feed pipe 114 is inserted into inlet port 54 as the centrifuge cover 115 is secured in place with fasteners 94.

The assembly of container 10 and centrifuge bowl 70 is then driven in rotation at appropriate speed, for example to generate a centrifugal force level of 300–500 Gs. Radwaste slurry containing resin powder or beads 128 is fed into the through inlet pipe 94 at rates of ten–twenty-five gallons per minute and subjected to centrifugal force with the resin material 128 being retained by filter cloth 50 while that liquid is expelled through fabric and support structure 46 for flow against surface 52 and upwardly to the outlet channels 66 between cover and base surfaces 26, 40 for flow radially outward through those channels and ports 98 of clamp ring 96 into gutter 84 and then for flow through drains 86 to collection trough 88. Seal 122 is centrifugally activated to prevent liquid from contacting the outer surface of container body 12.

When resin 128 is detected by level sensor 120 (due to obstruction of the end of tube 96), feeding of resin is terminated. Centrifugal action continues for five to ten minutes to dewater the resin 128.

After the dewatering is completed, rotation is stopped, cover 115 is removed, heater 68 is energized and the thermoplastic layers 18, 36 at the annular seal surfaces 26, 40 are melted and those surfaces are forced together to seal the container structure 10. After sealing, lifting eyes 140 are attached to projecting studs 142 and the sealed container 10 is removed from centrifuge bowl 78.

The separation system provides dewatering and compaction of radioactive waste in a container system that will withstand long term burial storage and minimizes exposure of personnel to radioactivity.

Figure 7:
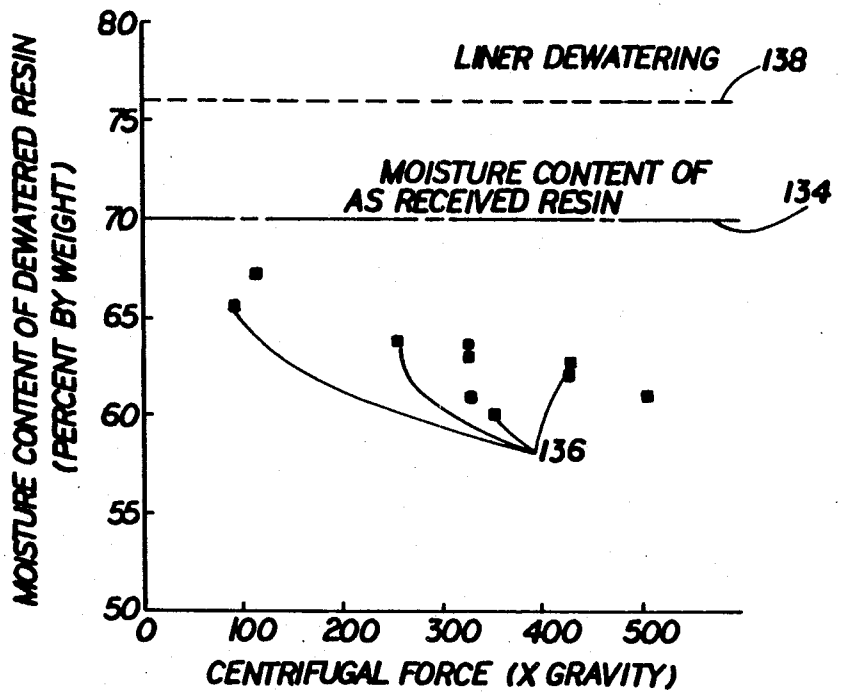
FIGS. 6 and 7 are graphs of separation characteristics of the system.
Figure 6:
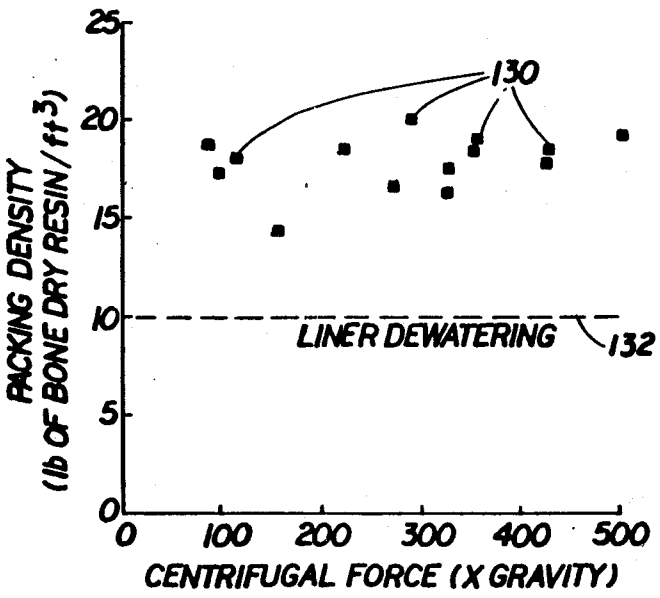

FIGS. 6 and 7 are graphs of packing density and moisture content of Ecodex X-203-H resin processed with the apparatus shown in FIGS. 1–5. With reference to FIG. 6, packing densities 130 in the order of 14 to 19 pounds of bone dry resin/cubic foot are obtained, in contrast with resin density of a prior art line dewatering system that provides a packing density of about ten pounds per cubic foot (line 132). Shown in FIG. 7 is the moisture content of Ecodex X-203-H resin after processing. The moisture content of as received Ecodex X-203-H resin was about seventy percent (line 134). After processing and dewatering, the moisture content of the Ecodex X-203-H resin ranged from 60 to 68 percent over the tested range of 80 Gs to 500 Gs. Thus, the dewatered product is two to ten percentage points dryer then the as received resin, and there is essentially no free water within the burial container 10. Similarly, the moisture content of the dewatered product is appreciably lower than that of prior art filtration type liner dewatering systems which provide moisture contents of about 76 percent (line 138).

While a particular embodiment of the invention has been shown and described, various modifications will be apparent to those skilled in the art, and therefore it is not intended that the invention be limited to the disclosed embodiment or to details thereof, and departures may be made therefrom within the spirit and scope of the invention.

What is claimed is:

1. Disposal container structure for use in disposal of radioactive waste materials and the like comprising, inner container structure that includes filter structure defining a chamber volume for receipt of waste material, said filter structure including a circumferential foraminous wall with filtering characteristics to retain solid material within said chamber volume while passing liquid material, and cover structure secured to said filter structure, said cover structure including means defining an inlet port, and a first annular seal surface of thermoplastic material at the periphery of said cover structure; and outer container structure having base and side wall portions that define a space for receiving said filter structure, and a second annular seal surface adjacent the top of said side wall structure for juxtaposition with said first annular seal structure, said first and second seal surfaces having a first configuration with said filter structure in said outer container structure providing liquid flow paths for flow of liquid from said chamber volume through said filter structure and externally of said container structure under the influence of centrifugal force, and a second configuration in which said seal surfaces are in sealing engagement to provide a sealed disposal container.

2. The container of claim 1 wherein the materials of said cover and outer container structures are polymeric materials with excellent resistance to chemical corrosion and ultraviolet and gamma radiation; and with tensile and compressive strengths in excess of 10,000 pounds per square inch.

3. The container of claim 1 wherein said chamber volume is at least about thirty gallons.

4. The container of claim 1 and further including clamp structure for mechanically securing said cover structure to said outer container structure with said seal surfaces in juxtaposed engagement.

5. The container of claim 4 wherein said clamp structure is of ring configuration and includes flow passages that are aligned with said flow paths of said container.

6. The container of claim 1 wherein said container further include structure for securing said container in centrifuge apparatus.

7. The container of claim 1 wherein said container structure is capable of withstanding centrifugal forces in excess of fifty Gs for dewaterinq and compactinq waste materials.

8. The container of claim 7, wherein said filter structure has an effective pore size of less than about one hundred microns.

9. The container of claim 1 wherein said seal surfaces are of thermoplastic materials and further including means for heating said seal surfaces to place said seal surfaces in said second configuration.

10. The container of claim 9 wherein said chamber volume is at least about thirty gallons and the materials of said cover and outer container structure, are polymeric materials with excellent resistance to chemical corrosion and ultraviolet and gamma radiation; and with tensile and compressive strengths in excess of 10,000 pounds per square inch.

11. The container of claim 10 and further including clamp structure for mechanically securing said cover structure to said outer container structure with said seal surfaces in juxtaposed engagement.

12. The container of claim 11 wherein said outer container structure includes flange structure adjacent said second seal surface and said clamp structure mechanically secures said flange structure to said cover structure and is arranged to exert a clamping force of at least fifty pounds on said engaged seal surfaces.

13. The container of claim 12 wherein said clamp structure is of ring configuration and includes flow passages that are aligned with said flow paths of said container.

14. The container of claim 13 wherein said container further includes bracket structure attached to said clamp structure for securing said container in centrifuge apparatus.

15. The container of claim 14 wherein said container structure is capable of withstanding centrifugal forces in excess of fifty Gs for dewatering and compacting waste materials.

16. The container of claim 15 wherein said filter structure has an effective pore size of less than about one hundred microns.

17. The container of claim 16 wherein said seal surfaces are of thermoplastic materials and further including means embedded in at least one of said inner layers for heating said seal surfaces to place said seal surfaces in said second configuration.

18. The container of claim 1 wherein said filter structure includes annular support structure and filter fabric disposed on the inner surface of said annular support structure that has a pore size of less than about one hundred microns for retaining solids within said chamber volume.

19. The container of claim 1 wherein said outer container structure includes an inner layer of thermoplastic material and an outer layer of fiber reinforced polymeric material laminated to said inner layer

20. The container structure of claim 19 wherein said cover member of said inner container structure includes an inner layer of thermoplastic material and an outer layer of fiber reinforced polymeric material laminated thereto and further including means embedded in said inner layer for heating said seal surfaces to place said seal surfaces in said second configuration.

21. A separation system for dewatering radioactive waste materials comprising disposal container structure for use in disposal of radioactive materials comprising inner container structure that includes filter structure defining a chamber volume of at least about five cubic feet, said filter structure including circumferential foraminous wall structure with filtering characteristics to retain solid material while passing liquid material, and lid structure secured to said filter structure, said lid structure including means defining an inlet port, and first annular seal structure of thermoplastic material at the periphery of said lid structure; and outer container structure including base and side wall portions that conform essentially to and for receiving said filter structure of said inner container structure, and second annular seal surface of thermoplastic material adjacent the top of said side wall structure for juxtaposition with said first annular seal surface, said first and second annular seal surfaces having a first configuration providing liquid flow paths for flow of liquids from the chamber volume defined by said filter structure through said filter structure for flow externally of said container structure under the influence of centrifugal force, and a second configuration in which said seal surfaces are in sealing engagement to provide a sealed high integrity disposal container;

drive structure for receiving said container structure, said drive structure including drain passage structure for alignment with said liquid flow paths provided by said first and second seal surfaces for liquid passed through said filter structure under the influence of centrifugal force, means for driving said drive structure in rotation to subject to said container to centrifugal forces in excess of fifty Gs, and means for releasably attaching said container structure to said drive structure.

22. The system of claim 21 wherein said drive structure includes frame structure, stationary circular drainage chamber structure for receiving liquids discharged from said container structure, and vibration isolation structure connected between said frame structure and said drainage chamber structure for accommodating changing mass distribution and varying center of gravity during system operation.

23. The system of claim 21 and further including feed tube structure adapted to be inserted through said inlet port for introducing waste material to be dewatered into said chamber volume, and material sensing apparatus coupled to said feed tube, said material sensing apparatus including conduit structure that extends into said container through said inlet port and sensor means coupled to said conduit structure external of said drive structure for sensing the quantity of material in said container.

24. The system of claim 23 wherein said chamber volume is at least about thirty gallons; and the materials of said lid and outer container structure are polymeric materials with excellent resistance to chemical corrosion and ultraviolet and gamma radiation; and have tensile and compressive strengths in excess of 10,000 pounds per square inch.

25. The system of claim 21 wherein said outer container structure includes flange structure adjacent said second seal surface and said structure for mechanically securing said outer container structure to said cover structure is adapted to exert a clampin force of at least fifty pounds on said engaged seal surfaces.

26. The system of claim 25 and further including bracket structure attached to said clamp structure for securing said container in said drive apparatus.

27. The system of claim 26 wherein said filter structure has an effective pore size of less than about one hundred microns.

28. The system of claim 21 and further including means for heating said seal surfaces to place said seal surfaces in said second configuration.

29. The system of claim 21 wherein said filter structure includes annular support structure and filter fabric disposed on the inner surface of said annular support structure that has a pore size of less than about one hundred microns for retaining solids within said chamber volume.

30. The system of claim 29 wherein said outer container structure includes an inner layer of thermoplastic material and an outer layer of fiber reinforced polymeric material laminated to said inner layer; said cover member of said inner container structure includes an inner layer of thermoplastic material and an outer layer of fiber reinforced polymeric material laminated thereto and further including means embedded in at least one of said inner layers for heating said seal surfaces to place said seal surfaces in said second configuration.

* * * * *

UNITED STATES PATENT AND TRADEMARK OFFICE

CERTIFICATE OF CORRECTION

PATENT NO. : 4,882,094

DATED : November 21, 1989

INVENTOR(S) : Leslie S. Rubin, et al.

It is certified that error appears in the above–identified patent and that said Letters Patent is hereby corrected as shown below:

Col. 1, line 33, "cove" should be --cover--.

Col. 2, line 35, after "structure" delete ",". (2nd occurrence.)

Col. 6, line 28, claim 6, "include" should be --includes--.
line 32, claim 7, "dewateringq" should be --dewatering--.
line 32, claim 7, "compactinq" should be --compacting--.
line 43, claim 10, "structure," should be --structures--.

Col. 7, line 21, claim 19, after "layer" insert ".".

Col. 8, line 1, claim 21, before "liquid" insert --receiving--.
line 37, claim 25, "clampin" should be --clamping--.

Signed and Sealed this

Eighth Day of January, 1991

*Attest:*

HARRY F. MANBECK, JR.

*Attesting Officer*

*Commissioner of Patents and Trademarks*